US009815112B2

(12) United States Patent
Hackl et al.

(10) Patent No.: US 9,815,112 B2
(45) Date of Patent: Nov. 14, 2017

(54) REFRACTORY IMPACT PAD

(71) Applicant: REFRACTORY INTELLECTUAL PROPERTY GMBH & CO. KG, Vienna (AT)

(72) Inventors: Gernot Hackl, Trofaiach (AT); Gernot Lukesch, Leoben (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 127 days.

(21) Appl. No.: 14/764,124

(22) PCT Filed: Feb. 7, 2014

(86) PCT No.: PCT/EP2014/052433
§ 371 (c)(1),
(2) Date: Aug. 11, 2015

(87) PCT Pub. No.: WO2014/128013
PCT Pub. Date: Aug. 28, 2014

(65) Prior Publication Data

US 2015/0375300 A1 Dec. 31, 2015

(30) Foreign Application Priority Data

Feb. 25, 2013 (EP) ..... 13156501

(51) Int. Cl.
*B22D 41/08* (2006.01)
*B22D 41/00* (2006.01)

(52) U.S. Cl.
CPC ..... *B22D 41/003* (2013.01)

(58) Field of Classification Search
CPC ..... B22D 41/003
USPC ..... 266/236
See application file for complete search history.

(56) References Cited

U.S. PATENT DOCUMENTS

| | | | | |
|---|---|---|---|---|
| RE35,685 | E | 12/1997 | Schmidt et al. | |
| 9,511,419 | B2 * | 12/2016 | Avila | B22D 11/10 |
| 2015/0375300 | A1 * | 12/2015 | Hackl | B22D 41/003 266/283 |

FOREIGN PATENT DOCUMENTS

| | | | |
|---|---|---|---|
| EP | 0847821 | A1 | 6/1998 |
| EP | 1526940 | B1 | 12/2005 |
| WO | 95/13890 | A1 | 5/1995 |
| WO | 03/082499 | A1 | 10/2003 |
| WO | 2009/048810 | A1 | 4/2009 |
| WO | 2012/012853 | A1 | 2/2012 |

OTHER PUBLICATIONS

Hajduk, Micheal, Impact Pad, DPMA Erfinderaktivitaten, Publikation Deutsches Patent—Und Markenamt—vol. 2003, 2004, pp. 40-44, XP002440519.

International Search Report for App. No. PCT/EP2014/052433 dated Jul. 24, 2014.

* cited by examiner

*Primary Examiner* — Scott Kastler
(74) *Attorney, Agent, or Firm* — Medley, Behrens & Lewis, LLC

(57) ABSTRACT

The invention relates to a refractory (fireproof) impact pad (also called impact pot).

15 Claims, 2 Drawing Sheets

Figure 2:
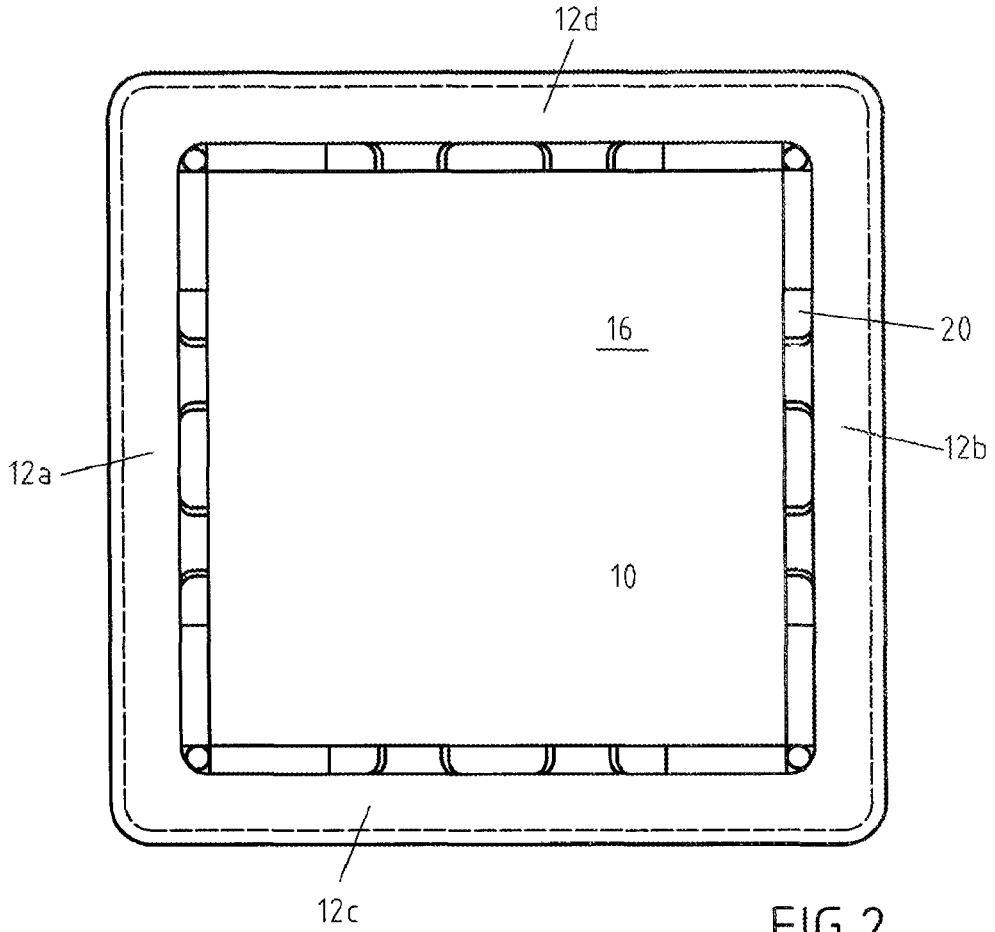

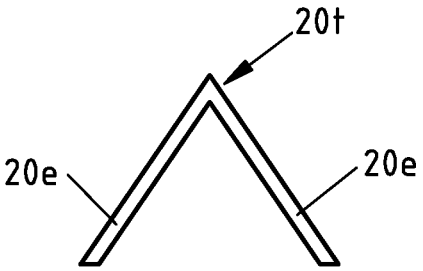
FIG.3.1
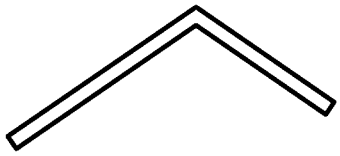
FIG.3.2
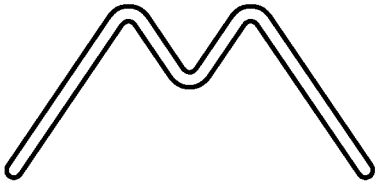
FIG.3.3
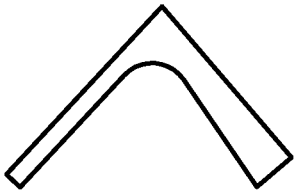
FIG.3.4
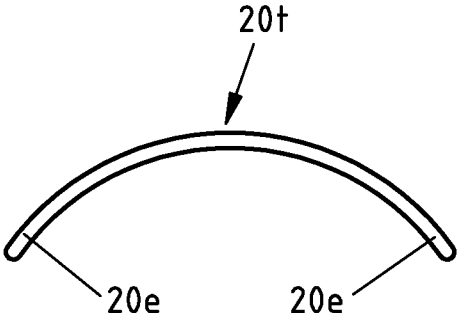
FIG.3.5

REFRACTORY IMPACT PAD

The invention relates to a refractory (fireproof) impact pad (also called impact pot). A generic impact pad is known—for example—from either of the following publications: WO 95/13890, WO 2009/048810 A1, WO 03/082499 A1 and WO 2012/012853 A1.

All these refractory impact pads provide the following features in their use position: A tub like shape comprising

- a bottom with an upper impact surface,
- a wall with an inner surface,
- the wall extending from said bottom upwardly to an upper end of the impact pad,
- the inner surface of the wall and the upper impact surface of the bottom define a central space of the impact pad.

To reduce turbulences of the metal melt within the impact pad and/or the associated metallurgical vessel various constructional amendments have been made to the generic type of an impact pot, namely:

WO 95/13890: The inner surface of the wall includes an annular portion which extends inwardly and upwardly towards the circumferential upper end of the impact pad.

WO 2009/048810: The inner surface of the wall contains channel-like depressions, extending in a vertical direction.

WO 03/082499 A1: One or more portions of the circumferential upper end of the impact pad support so called overhangs which project inwardly into the central space of the impact pad.

WO 2012/012853 A1: While the inner surfaces of the wall are provided with barriers of rectangular shape the upper impact surface of the bottom provides corrugations.

During intensive research work it has been found that the turbulences mentioned may be reduced by either of the described constructional features.

Nevertheless there is still demand for improvements and especially to solve a problem not mentioned in any of the references cited, namely turbulences caused by misalignment of a ladle shroud (or a similar nozzle) by which the metal melt is fed into the said impact pad. This is in particular a problem with impact pads providing a reduced cross section along the upper inlet/outlet opening of the impact pad, that is the cross section of the defined central space at its uppermost end, namely at the circumferential upper end of the impact pad. This could then end up with splash at the beginning of a casting process and unfavourable flow pattern during steady state casting.

It is therefore an object of the invention to provide an impact pad which allows at least some of the following optimizations:

- An aimed guidance of the metal melt in the impact pad and associated metallurgical vessel,
- minimization of flow turbulences,
- low manufacturing costs.

In order to provide an impact pad which fulfils as many as possible of these criteria extensive test and investigations have been conducted, particularly regarding improved flow properties of the metal melt. In doing so, the following has been found:

- It is important to provide the impact pad with an inflow area of largest possible cross section. In most cases the inflow area will roughly correspond the outflow area.
- The inner surface of the impact pad wall should be provided with barriers, projecting from said inner surface into the defined central space to reduce the speed (velocity) of both inflowing and outflowing metal melt.

In this connection it was found that barriers shaped as an inverted V or W lead to best results (reduction of velocity, reduction of turbulences).

In its most general embodiment the invention relates to a refractory impact pad providing the following features in its use position:

- a bottom with an upper impact surface,
- a wall with an inner surface,
- the wall extending from said bottom upwardly to an upper end of the impact pad,
- the inner surface of the wall and the upper impact surface of the bottom define a central space,
- a plurality of barriers project from the inner surface of the wall into said space,
- said barriers are shaped as an inverted V or W with a corresponding number of legs, and
- said barriers are arranged with a distance to each other at least in a horizontal direction.

Said barriers may extend at a distance to the upper end of the impact pad.

Apparently, the barriers, protruding from the inner wall surface of the impact pad, provide the following influences onto the metal stream:

- With respect to the inflowing metal stream they act like a diffuser, distributing the metal stream into opposite directions both towards the bottom (impact surface) of the impact pad. This in particular important in case of a misalignment of an associated shroud and insofar in connection with a metal stream which does not exclusively hit the impact surface of the impact pad but as well adjacent wall sections. Splashing is mostly avoided as the overall cross-sectional area at the upper end of the impact pad is not effected by said barriers, due to their specific shape. These barriers are preferably arranged at a distance to the upper, in many cases circumferential end of the impact pad.
- With respect to any metal melt, which has been redirected from the bottom and adjacent wall portions of the impact pad the said barriers have the effect of focusing of the metal stream along the opposed inclined or curved legs of the barriers up to the transition area between the legs of the respective barrier. This transition area, which may be angled or curved, is responsible for a remarkable reduction in velocity of the metal melt as could be proved reproducibly in computer simulations.
- The angled design (inverted V, inverted W) has the further advantage of an overall increased length of a corresponding barrier (in a horizontal direction), compared with a straight, linear and horizontally arranged barrier as disclosed in WO 2012/012853 A1.

The invention further provides the following amendments/improvements:

The barriers may be arranged at different distances to the upper impact surface or at different distances to the upper end of the impact pad or both. The different reference may be important in case of profiled impact surfaces and/or an upper end of the impact pad sloping toward at least one direction of the coordinate system.

At least some (or all) of the said barriers may be arranged at a distance to each other in a vertical direction while overlapping each other in a horizontal direction. This may lead to an overall arrangement wherein a metal melt flowing along the inner wall surface of the impact pad will contact at least one of the said barriers, namely its respective upper or lower contact surface. This embodiment is disclosed in the attached drawing.

The cross-sectional profile of the barriers may vary. It may be, i. a., rectangular, semicircular, triangular or oval. Combinations thereof may also be used.

As already disclosed above the said barriers may be designed such that a specific angle is formed between the barrier legs, wherein said angle may vary between >45° and <170° with a preferred lower value of >90° and a preferred upper value of <140°. Instead of a specific angle between the respective barrier legs the transition area between the legs may be curved.

The barrier legs may have the same or different lengths, typically they are shaped as straight legs or at least with straight sections but may be curved as well, for example convex (in a vertical direction and seen from below).

The dimensions of the barriers may vary depending on its specific use.

Typically the barriers project from the inner surface of the wall by at least 10 mm with a maximum at about 50 mm.

While the shortest distance between adjacent barriers being typically at least 5 mm (or at least 10 mm) the shortest distance typically is 60 mm at most, typically 40 mm at most.

The said barriers may be an integral part of the impact pad. In other words, the wall and the barriers are provided by one ceramic part. Production of a corresponding impact pad may include use of a so called "lost template", for example a template of a combustible material which will be burnt off after production of the impact pad.

As already expressed previously, the wall of the impact pad, an its upper end, has no or at least no substantial protrusion towards the inner space of the impact pad. This in an important feature to provide the inflow area with largest possible cross-section and to avoid splashing of the metal melt even in the case of misalignment of the metal stream.

The invention includes the option to provide further barrier means of different shape, including barriers shaped as a V or W and arranged between said barriers shaped as an inverted V or an inverted W.

According to another embodiment of the invention the barriers shaped as an inverted V or inverted W extend over at least 80%, for example >85%, >90%, >95% of the circumferential length of the inner surface of the wall.

This is to provide the barrier function for more or less the complete metal stream flowing along the wall area upwardly towards the outlet opening of the impact pad.

The impact pad may have any, i. a. a cylindrical shape or a cuboid shape, i. e. a circular or rectangular bottom and correspondingly one continuous wall or a wall made of several (4) wall sections, as shown in the attached drawing.

Further features of the invention are disclosed by the sub claims and the other application documents, including the following embodiments as illustrated by drawings and explained in writing.

Figure 1:
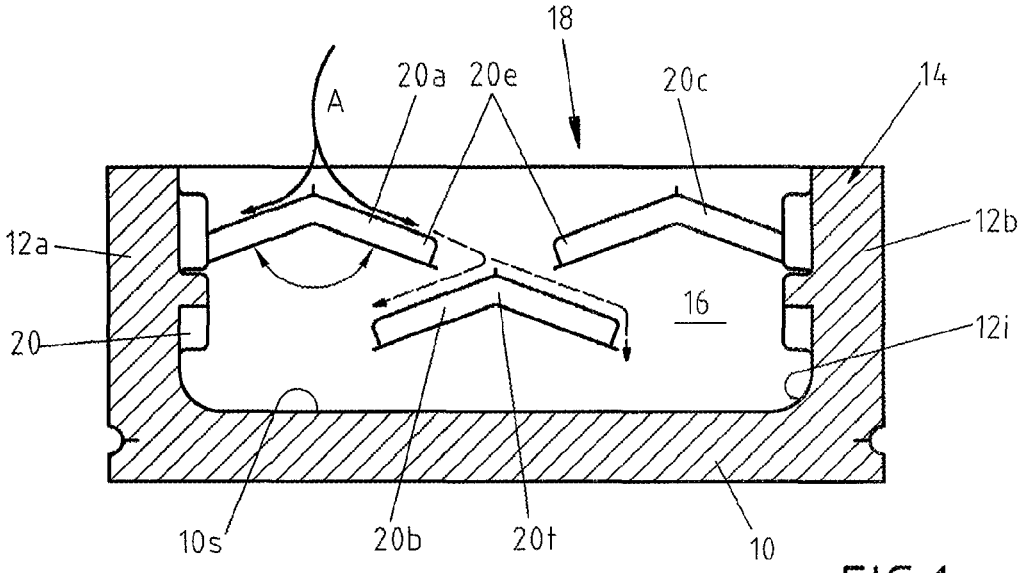

The Figures show, each in a schematic representation:

FIG. 1: A longitudinal section of an impact pad according to the invention.

FIG. 2: A top view on the impact pad according to FIG. 1.

FIGS. 3.1-3.5: Possible shapes of an inverted V- or W-barrier.

The impact pad comprises a bottom 10 with an upper impact surface 10*s*. Bottom 10 (and correspondingly impact surface 10*s*) is of rectangular shape. Insofar wall 12 of said impact pad is made of four wall sections 12*a, b, c, d,* integral with each other and extending from said bottom upwardly to a circumferential (squared) upper end 14 of the impact pad.

The inner surface 12*i* of said wall 12 and the upper impact surface 10*s* of bottom 10 define a central space 16 of the impact pad as well as a squared inlet/outlet opening 18 for a melt at the upper end 14.

The impact pad is characterized by a plurality of barriers 20.

According to FIG. 1 wall section 12*d* is equipped with three barriers 20*a, b, c* arranged at a distance to each other, wherein two barriers 20*a, c* are arranged above the third barrier 20*b*, which third barrier 20*b* being placed such that it overlaps corresponding legs 201 of the other two barriers 20*a, c*.

FIG. 1 further shows barriers 20 at adjacent wall sections 12*b*, 12*a*, partly in a longitudinal sectional view. All barriers 20 have the same shape and size. According to FIG. 1 they are designed as an inverted V. In other words: They have a "roof-like shape" in a side view providing an angle α of 135° between its respective legs 201.

In the present embodiment the minimum distance between adjacent barriers 20, 20*a, b, c* between a barrier 20 and the impact surface 20*s*, between each barrier 20, 20*a, b, c* and the upper circumferential end 14 is about 20 mm.

Arrow A symbolizes the flow of a metal stream when entering the impact pad in the proximity of a corresponding wall section 12*a* . . . 12*d*. The inverted V-shape of the barriers 20 causes the metal stream to split up into partial streams which then follow the shape of the corresponding barrier 20 in opposite directions. These partial streams may hit further barriers arranged below the said first barrier (as indicated in FIG. 1) and may be split up again in a similar way as described above.

Any metal stream flowing upwardly within the impact pad (its space 16) in the proximity of a wall section 12*a* . . . 12*d* will hit the lower contact surface of the corresponding barrier 20 and follow the corresponding sloped contact area at least up to the transition area 20*t* of the respective barrier 20 before turning inwardly (into space 16) and then upwardly to leave the set impact pad via opening 18.

FIGS. 3.1 and 3.2 each represent a barrier of a standard inverted V-shape, FIG. 3.2 with one shortened leg.

FIG. 3.3 shows and inverted W-barrier with curved inner and outer transition areas between the W-legs.

The barrier of FIG. 3.4 has an angled outer transition area, a curved inner transition area and legs of different width.

FIG. 3.5 represents a barrier similar to FIG. 3.2 but with slightly curved legs, while the general shape of an inverted V is maintained.

It has been proved by computer simulation and water modeling experiments that this impact pad allows reductions in the velocity of the metal stream, reduces turbulences within the impact pad, reduces the surface velocity and the surface turbulences within the corresponding metallurgical vessel, compared with all types of prior art devices as mentioned above. It further minimizes the risk of splashing in case of a misaligned shroud.

This is an indication for a more efficient energy dissipation inside the impact pad.

The invention claimed is:

1. Refractory impact pad providing the following features in its use position:

a) a bottom (10) with an upper impact surface (10*s*), b) a wall (12) with an inner surface (12*i*), c) the wall (12) extending from said bottom (10) upwardly to an upper end (14) of the impact pad, d) the inner surface of the wall (12) and the upper impact surface (10*s*) of the bottom (10) define a space (16), e) a plurality of barriers (20) project from the inner surface (12*i*) of the wall (12) into said space (16), f) said barriers (20) are shaped as an inverted V or inverted W with a corresponding number of legs (201), and g) said barriers (20) are arranged with a distance to each other at least in a horizontal direction.

2. Impact pad according to claim 1, wherein the said barriers (20) are arranged at different distances to the upper impact surface or at different distances to the upper end (14) of the impact pad or both.

3. Impact pad according to claim 1, wherein some or all of the said barriers (20) which are arranged at a distance to each other in a vertical direction are overlapping each other in a horizontal direction.

4. Impact pad according to claim 1, wherein some or all of the said barriers (20) are designed with at least one cross-sectional profile of the group comprising: rectangular cross-section, triangular, semi-circular cross-section, oval cross-section or combinations thereof.

5. Impact pad according to claim 1, wherein some or all of the said barriers (20) are designed as an inverted V or inverted W with an angle of between >45° and <170° between two adjacent legs (201).

6. Impact pad according to claim 1, wherein some or all of the said barriers (20) are designed with legs (201) or different lengths.

7. Impact pad according to claim 1, wherein some or all of the said barriers (20) project from the inner surface (12*i*) of the wall by at least 10 mm.

8. Impact pad according to claim 1, wherein some or all of the said barriers (20) project from the inner surface (12*i*) of the wall by 50 mm at most.

9. Impact pad according to claim 1, wherein the shortest distance between adjacent barriers (20) is at least 5 mm.

10. Impact pad according to claim 1, wherein the shortest distance of adjacent barriers (20) is 40 mm at most.

11. Impact pad according to claim 1, wherein the barriers (20) are an integral part of the impact pad.

12. Impact pad according to claim 1, wherein the wall (12), at its upper end (14), has no protrusion towards the space (16).

13. Impact pad according to claim 1, wherein the legs (201) of at least one barrier (20) of an inverted V or inverted W have a curved transition area (20*t*) between the legs (201).

14. Impact pad according to claim 1 with at least one further barrier shaped as a V or W and arranged between said barriers (20) shaped as an inverted V or inverted W.

15. Impact pad according to claim 1, wherein the barriers (20) extend over at least 80% of the circumferential length of the inner surface (12*i*) of the wall (12).

* * * * *